United States Patent [19]

Matsuzaki

[11] Patent Number: 4,618,317

[45] Date of Patent: Oct. 21, 1986

[54] ROTARY TYPE FLUID COMPRESSOR

[75] Inventor: Michiyoshi Matsuzaki, Saitama, Japan

[73] Assignee: Nippon Piston Ring Co., Ltd., Tokyo, Japan

[21] Appl. No.: 556,665

[22] Filed: Nov. 30, 1983

[30] Foreign Application Priority Data

Nov. 30, 1982 [JP] Japan ..... 57-208567

[51] Int. Cl.[4] ..... F04C 15/00

[52] U.S. Cl. ..... 418/63; 418/179

[58] Field of Search ..... 428/591, 682, 627, 628, 428/610; 418/179, 63; 75/126 R, 126 E, 126 C

[56] References Cited

U.S. PATENT DOCUMENTS

| | | | |
|---|---|---|---|
| 2,176,388 | 10/1939 | Bochmann | 418/179 |
| 2,312,655 | 3/1943 | Lauck | 418/179 |
| 2,345,975 | 4/1944 | Herman | 418/179 |
| 3,033,180 | 5/1962 | Bentele | 418/179 |
| 3,245,387 | 4/1966 | Froede | 418/179 |
| 4,225,294 | 9/1980 | Kakuwa et al. | 418/179 |

FOREIGN PATENT DOCUMENTS

| | | | |
|---|---|---|---|
| 521343 | 1/1956 | Canada | 75/126 E |
| 3046335 | 9/1981 | Fed. Rep. of Germany | 418/179 |
| 34773 | 10/1971 | Japan | 75/126 C |
| 7533 | 3/1975 | Japan | 75/126 E |
| 125607 | 11/1978 | Japan | 418/179 |
| 125608 | 11/1978 | Japan | 418/179 |
| 13005 | 1/1979 | Japan | 418/179 |
| 25571 | 2/1980 | Japan | 418/179 |
| 69726 | 5/1980 | Japan | 418/179 |
| 47203 | 11/1980 | Japan | 418/179 |
| 10786 | 1/1982 | Japan | 418/179 |
| 608711 | 9/1948 | United Kingdom | 418/179 |

OTHER PUBLICATIONS

"Standard Stainless and Heat Resisting Steels", 1a Iron and Steels, *Metal Progress*—Mid-Jun. 1978, pp. 60–63, 70–73.

*Primary Examiner*—Melvyn J. Andrews
*Assistant Examiner*—John J. Zimmerman
*Attorney, Agent, or Firm*—Sughrue, Mion, Zinn, Macpeak, and Seas

[57] ABSTRACT

A rotary-type fluid compressor is disclosed. The compressor includes a housing having a vane groove therein which is fitted with a vane. The vane is comprised of a specific soft nitrided hardened steel material which includes 0.50 to 1.30% carbon by weight, 11.0 to 20.0% chromium by weight, with the balance being Fe. The hardened steel material can be further improved by the inclusion of one or both of 0.1 to 1.50% Mo and/or 0.07 to 0.15% by weight of V. Specific characteristics relating to the mating member over which the vane slides are also disclosed. Due to the particular material utilized for producing the vane and the characteristics of the mating member over which the vane slides, improved results are obtained with respect to wear resistance.

4 Claims, 3 Drawing Figures

ROTARY TYPE FLUID COMPRESSOR

BACKGROUND OF THE INVENTION

In a rotary type fluid compressor, as for example, an oscillating rotor-type fluid compressor, as shown in FIG. 1, a vane 4 is accessibly and separably fitted in a vane groove 3 formed in a rotor housing 2 within a case 1 and a rotor 5 is in turn rotatably mounted over a crank shaft 6 concentrical with the rotor housing 6. Biased by a spring, the vane 4 is urged in and out with respect to the rotor housing 2 in response to rotation of the eccentric rotor 5. The vane 4, as shown in FIG. 2, is inclined in the direction of rotation of the rotor 5 and slides in the vane groove so that wear occurs on the vane tip 10, inlet 9 of the vane groove 3, one side 11 and a back end 12 of the vane 4, and one side (facing side 8) of the vane groove 3. Such wearing can cause problems. The vane side 11 and the vane inlet 9 are subjected to not only sliding wear but also galling wear due to the presence of abrading particles and particles of foreign matter which collect in the vane groove 3. For this reason, the vane of a rotary type fluid compressor must be made from material which has remarkable wear resistance.

High carbon chrome-bearing steel (Japanese Industrial Standard (JIS) No. SUJ 2) and high speed tool steel (JIS No. SKH 9) and the like have been heretofore considered as important steel materials. However, the use of such materials still has problems related to wear resistance. More specifically, a vane made from the material JIS No. SUJ 2 is poor in wear resistance because it contains only a small quantity of precipitated Cr carbide of high hardness. Therefore, such a vane is often subjected to excessive wear as compared with the roller and vane groove mating elements when a high load is applied thereto and it is continuously used. On the other hand, a vane made of the material JIS No. SKH 9 is likely to considerably wear the roller and the vane groove since the carbide of high hardness, including Cr, Mo. W, and V is excessively precipitated. This tendency becomes prominent where the surface is very rough.

SUMMARY OF THE INVENTION

The present invention is contemplated to provide an ideal rotary type fluid compressor in which a vane member contains a high percentage of Cr, as opposed to the aforementioned vane member, and is subjected to softnitriding treatment to moderate the quantity of Chromium carbide precipitated, thereby providing the vane member with improved frictional affinity with respect to the roller and vane groove.

The rotary-type fluid compressor according to the invention is characterized in that the vane member is made 0.5 to 1.30% C, 11.0 to 20.0% Cr, and the remainder Fe.

DESCRIPTION OF THE PREFERRED EMBODIMENTS

The reasons for the numerical limitations specified above on the aforementioned composition will now be explained. If more than 1.30% carbon is present in the steel for the vane, excessive formation of coarse chromium carbide results, creating excessive wear resistance, whereas the presence of less than 0.50% carbon reduces the formation of chromium carbide, lessening the wear resistance. The amount of chromium is closely related to the amount of carbon, and in this instance is contained in an amount of from 11.0 to 20.0%. The presence of more than 20% chromium in steel materials for the vane results in excessive formation of chromium carbide which can cause the mating member to be considerably worn, whereas the presence of less than 11.0% chromium decreases the formation of chromium carbide, which not only weakens the wear resistance but results in poor corrosion resistance.

A preferred embodiment of the vane includes both or either one of 0.10 to 1.50% molybdenum and 0.07 to 0.15% vanadium. That is, hardenability is improved by the presence of molybdenum within the range of 0.10% to 1.5%. The presence of vanadium in the range of 0.07 to 0.15% makes an effective contribution to the formation of the carbide.

The vane for use in a rotary-type fluid compressor preferably contains less than 1.0% silicon, less than 1.0 manganese, less than 0.06% phosphorus, less than 0.05% sulfur, and less than 1.0% nickel. More than 1.0% silicon reduces the amount of the carbide precipitated which causes a decrease in ductility. The presence of more than 1.0% silicon is desirable with respect to increasing toughness, but it is highly expensive.

The vane member comprised as defined above can be provided with increased surface hardness by being subjected to a soft-nitriding treatment upon hardening. Such treatment not only lessens the extent of wear of the mating member, but also improves antiscuffing, resistance to fatigue, and anticorrosion characteristics. This treatment is effected by heating the vane member material to a temperature of from 560° to 600° C. over a period of 30 to 180 min. The treatment conditions such as time and temperature are controlled so as to provide a nitrided layer having a thickness of more than 5$\mu$ from the surface.

In order to provide excellent wear resistance for the vane used in the rotary type fluid compressor, the mating roller member is preferably made so that it meets the following conditions. That is, the mating roller member is compressed of cast iron containing, in amount of 0.10 to 6.00% carbide and having a graphite configuration, any of the grades A, D, and E stipulated in ASTM and having the structure of tempered martensite and a Rockwell C hardness (HRC) of 40 to 55.

Figure 1:
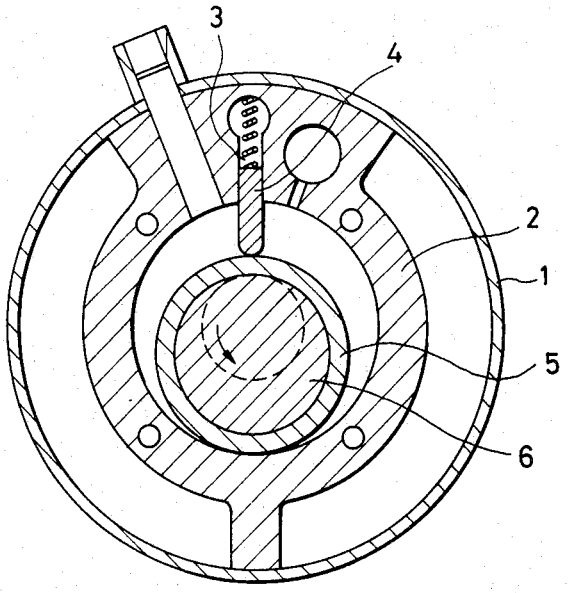
FIG. 1 is a sectional view of an important part of an oscillating rotor type fluid compressor.
Figure 2:
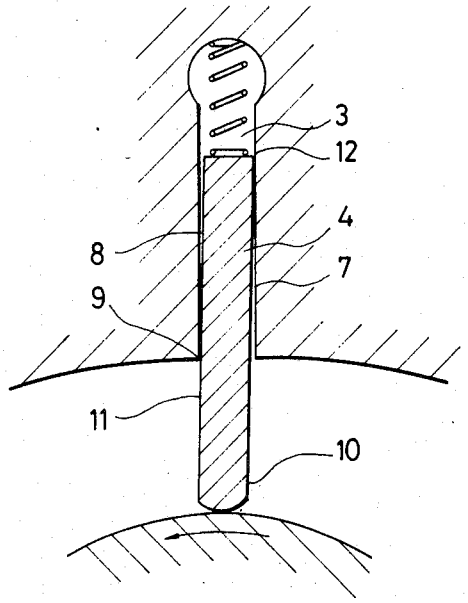
FIG. 2 is an enlarged, sectional view of the vane as shown in FIG. 1.
Figure 3:
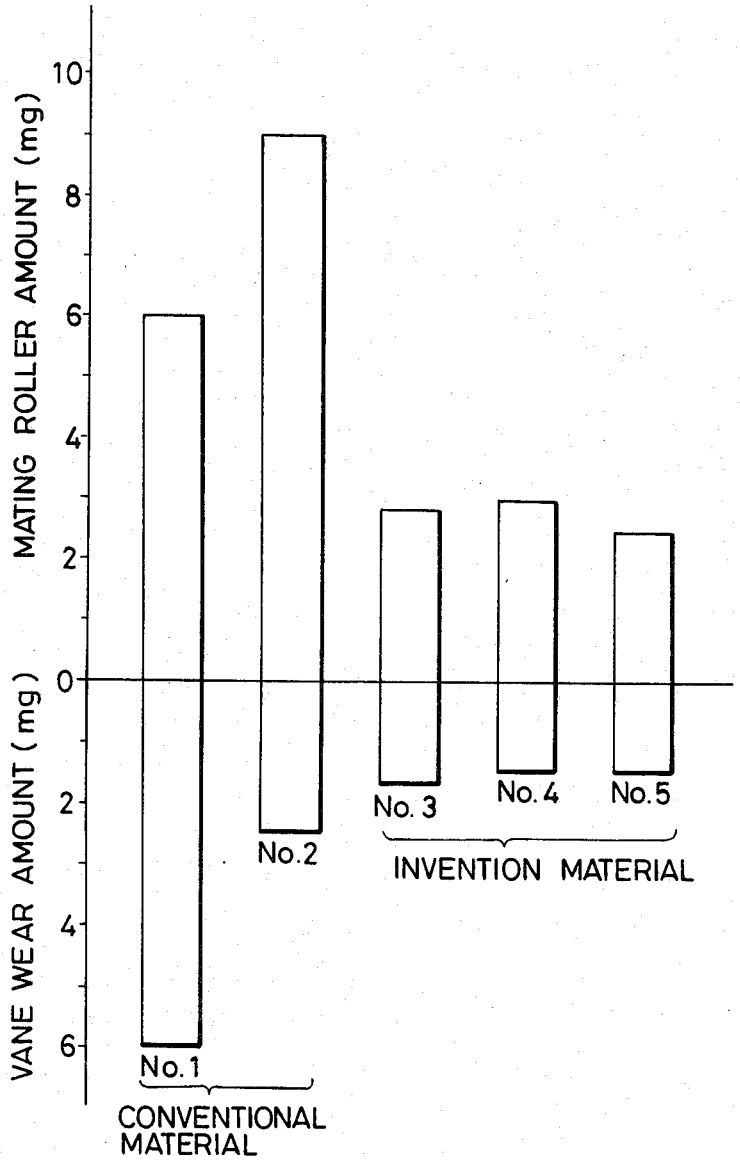
FIG. 3 is a graph showing abrasion test results.

Table 1 shows a comparison between a conventional vane member, a vane member according to the invention and the mating roller member with respect to composition and hardness. FIG. 3 shows the result of abrasion testing obtained which corresponds to such comparison. The test was carried out by the Amsler abrasion testing technique. More specifically, the test was conducted in such a manner that the vane member was made a fixed segment in a surface contact sliding abrasion testing machine and was adapted to abut against the mating member such as a disc sample made from various cast iron materials. Lubricating oil was continuously applied to the pressure surface while the disc sample was rotated. The conditions for the test were as follows:

Lubricating oil—SUNISO 4GD 1D, (product of Japan Sun Oil Co.)

oil temperature—80° C., load—200 kg, sliding velocity—0.5 m/sec, oil pan system—containing 200 cc.

As is apparent from the result plotted in FIG. 3, both the mating roller member and the vane member of present invention are remarkably reduced with respect to their wear rate.

TABLE

| Specimens | Chemical Compositions (wt %) C | Si | Mn | P | S | Cr | Mo | V | W | Ni | Fe | Hardness (HRC) | Remarks |
|---|---|---|---|---|---|---|---|---|---|---|---|---|---|
| Vane Material: | | | | | | | | | | | | | |
| Conventional Material | | | | | | | | | | | | | |
| No. 1 | 1.00 | 0.20 | 0.30 | 0.01 | 0.01 | 1.45 | — | — | — | — | Balance | 58 | SUJ2, hardening |
| No. 2 | 0.85 | 0.20 | 0.25 | 0.01 | 0.01 | 4.00 | 5.50 | 1.78 | 6.13 | — | " | 62 | SKH9, hardening |
| Invention Material | | | | | | | | | | | | | |
| No. 3 | 1.00 | 0.06 | 0.05 | 0.03 | 0.02 | 16.8 | — | — | — | — | " | 48 | Hardening & low temperature gas nitriding treatment |
| No. 4 | 1.00 | 0.06 | 0.05 | 0.03 | 0.02 | 16.8 | — | — | — | — | " | 48 | Hardening & low temperature gas nitriding treatment |
| No. 5 | 1.00 | 0.06 | 0.05 | 0.03 | 0.02 | 16.8 | — | — | — | — | " | 48 | Hardening & low temperature gas nitriding treatment |
| Mating Roller Material: | | | | | | | | | | | | | |
| No. 1 | 3.20 | 2.00 | 0.88 | 0.18 | 0.08 | 0.92 | 0.18 | — | — | 0.19 | " | 48 | Mo—Ni—Cr cast iron |
| No. 2 | 3.20 | 2.00 | 0.88 | 0.18 | 0.08 | 0.92 | 0.18 | — | — | 0.19 | " | 48 | Mo—Ni—Cr cast iron |
| No. 3 | 3.20 | 2.20 | 0.80 | 0.10 | 0.07 | — | — | — | — | — | " | 46 | Grey cast iron |
| No. 4 | 2.02 | 3.18 | 0.60 | 0.10 | 0.07 | — | — | — | — | — | " | 46 | Eutectic graphite cast iron |
| No. 5 | 3.30 | 2.18 | 0.80 | 0.10 | 0.07 | 0.92 | 0.18 | — | — | 0.19 | " | 47 | Mo—Ni—Cr cast iron |

I claim:

1. A rotary-type fluid compressor, comprising:

a housing having a vane groove therein; and a vane fitted in the vane groove, and a member mating with said vane, the vane being formed of a soft nitrided hardened steel material comprising 0.50 to 1.30% C by weight, 11.0 to 20.0% Cr by weight, with the balance being predominantly Fe; and said mating member being formed of cast iron containing 0.10 to 6.00% carbide, the cast iron having a graphite configuration and a grade selected from the group consisting of ASTM grades A, D, and E, the iron having the structure of tempered martensite and a Rockwell C hardness (HRC) in the range of 40 to 55.

2. A rotary-type fluid compressor as claimed in claim 1, wherein the hardened steel material comprises at least one of 0.10 to 1.50% Mo and 0.07 to 0.15% V.

3. A rotary-type fluid compressor as claimed in claim 1, wherein said soft-nitriding treatment has been carried out at a temperature in the range of 560° C. to 600° C. over a period of time of 30 to 180 minutes.

4. A rotary-type fluid compressor as claimed in claim 3, wherein the treatment has been carried out until the vane has been coated with a nitrided layer to a thickness of 5 μm or more.

* * * * *